United States Patent [19]

Turner

[11] Patent Number: 4,825,615

[45] Date of Patent: May 2, 1989

[54] DOOR WITH LIGHT-TRANSMITTING PANEL

[75] Inventor: Terry A. Turner, Prineville, Oreg.

[73] Assignee: Tru-Line Manufacturing, Inc., Redmond, Oreg.

[21] Appl. No.: 64,763

[22] Filed: Jun. 19, 1987

[51] Int. Cl.[4] ..... E06B 3/70; E06B 3/54

[52] U.S. Cl. ..... 52/455; 52/475; 52/656

[58] Field of Search ..... 52/455, 456, 457, 458, 52/656, 475, 474, 807, 211

[56] References Cited

U.S. PATENT DOCUMENTS

| | | | |
|---|---|---|---|
| 432,504 | 7/1890 | Amsden | 52/455 |
| 435,313 | 8/1890 | Lohse | 52/455 |
| 563,779 | 7/1896 | Mathenson et al. | 52/455 |
| 968,108 | 8/1910 | Badder | 52/455 |
| 1,524,910 | 2/1925 | Carmichael | 52/455 |
| 2,312,987 | 3/1943 | Grassick | 52/807 X |
| 2,822,870 | 2/1958 | Haynes | 52/455 |
| 3,184,802 | 5/1965 | Levy | 52/656 X |
| 4,387,545 | 6/1983 | Kern | 52/455 |

*Primary Examiner*—Michael Safavi

*Attorney, Agent, or Firm*—Kolisch, Hartwell & Dickinson

[57] ABSTRACT

A door including an integrated panel core having an opening in the core for receiving a light-transmitting panel. Edge band stripes extend in covering relation over edges of the panel core. Core faces and margins of edge band strips are overlaid with veneer. Molding strips mounted at least partially in the opening support opposite side margins of the light-transmitting panel.

2 Claims, 2 Drawing Sheets

DOOR WITH LIGHT-TRANSMITTING PANEL

BACKGROUND AND SUMMARY OF THE INVENTION

This invention relates generally to doors, and more particularly to doors and like structures which include framework bounding an opening in the framework which receives a light-transmitting panel in the door, this panel ordinarily being composed of glass or alternatively some form of clear or translucent plastic material. Exemplary of such doors are so-called patio or sliding doors, also sometimes referred to as rim doors, made up of a rim framework which extends about a light-transmitting panel of substantial size. Further exemplifying doors of the type contemplated are so-called lighted doors, which may be used as entry doors to a house, and which may include glass panes suitably mounted in an accommodating opening in the door permitting a limited passage of light through the door.

A general object of this invention is to provide an improved door with one or more light-transmitting panels incorporated therewith, featuring an integrated core panel providing the supporting framework in the door.

Another object is to provide such a door having a construction wherein the core panel lends itself to being overlaid with a decorative wood veneer, the completed door with overlay closely resembling a door made throughout with the overlay material. The core panel in the door may be made of plywood or plywood-like material composed of multiple veneer layers adhered together. With overlay applied and with the door incorporating other features as detailed herein, the core material is essentially completely obscured.

Because of the integrated nature of the core panel contemplated, a door constructed according to the invention has substantial strength and will not sag or otherwise distort over time with separation, for instance, of stiles and rails in the door as is experienced with many conventional forms of door.

Another feature and object of the invention is the provision of a door which may incorporate so-called "eye-brow" molding accommodating readily performed mounting within an opening in the door of light-transmitting panel structure, the molding imparting an attractive border effect to the light-transmitting panel which such molding encompasses. In another form of door, so-called edge banding strips in conjunction with molding strips are utilized in the mounting of the light-transmittng panel with concealment of a core piece which forms a major portion of the door framework.

These and other objects and advantages are attained by the invention, which is described herein below in conjunction with the accompanying drawings, wherein.

Figure 4:
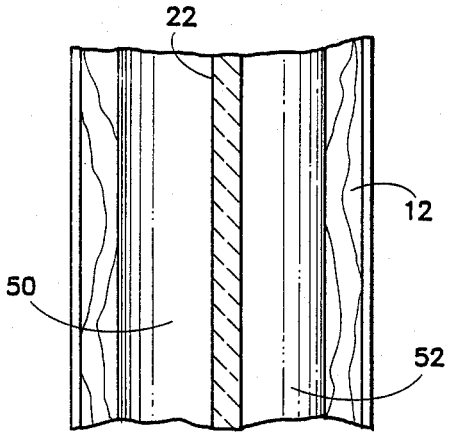
FIG. 4 is a cross-sectional view, further enlarged, taken generally along the line 4—4 in FIG. 3.
Figure 1:
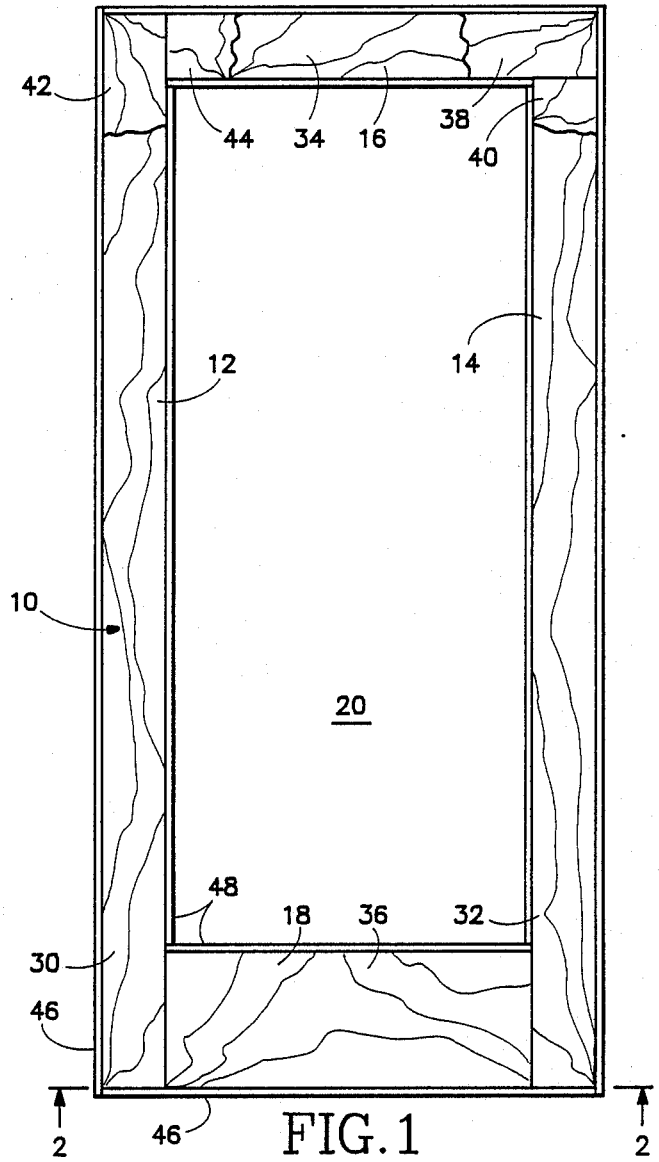
FIG. 1 is a view illustrating the face of a core piece with banding strips applied to the core piece to form a core panel, the core panel being a subassembly prepared in the manufacture of a patio-type door according to one embodiment of the invention.
Figure 2:
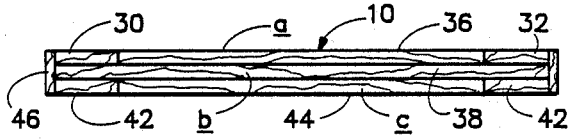
FIG. 2 is a cross-sectional view, taken generally along the line 2—2 in FIG. 1.
Figure 3:
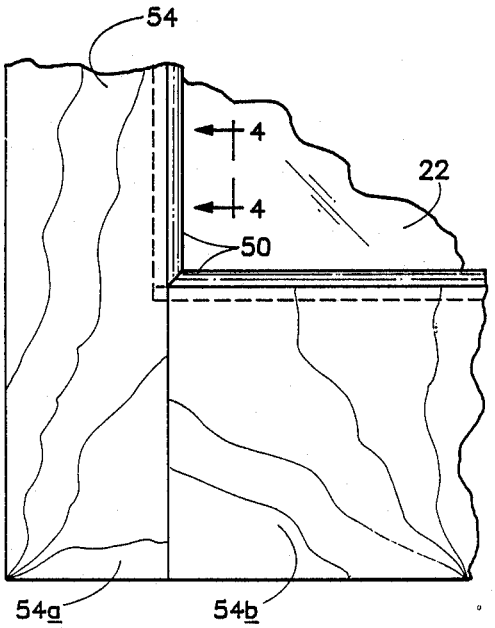
FIG. 3 is a view (somewhat enlarged) illustrating a corner portion of a completed door constructed from the core piece and banding strips illustrated in FIG. 1.

Referring now to the drawings, and initially to FIGS. 1, 2, and 3 picturing one embodiment of the invention as the invention might be incorporated in a patio-type door, or so-called "rim" door, illustrated generally at 10 is a core piece for the door of generally rectangular outline. The core includes elongate vertical expanses 12 and 14, which take the place of stiles in a conventional door, and elongate horizontal expanses 16, 18, which take the place of rails in a conventional door. These horizontal and vertical expanses bound an opening 20 in the core, piece which receives a light-transmitting panel present in the completed door, portions of which are shown at 22 in FIG. 3.

The core piece may be made of a relatively available material such as plywood, such material, as is well known, being made up of multiple veneer layers stacked one above the other, usually with cross banding, and adhesively secured to each other. The plywood is assembled in the core piece in such a manner that at corner regions in the core piece, i.e., those regions where the horizontal and vertical expanses merge, veneer layers which are a continuation of a horizontal expanse are sandwiched between layers which are a continuation of a vertical expanse. In this way there is integration of the panel which inhibits sagging, distorting, or other deforming of the panel during the life of the door.

Figure 8:
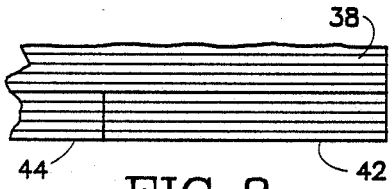
FIG. 8 is a view, somewhat enlarged, of lower right hand portions of FIG. 2.

Further explaining, and in the particular embodiment of the core piece disclosed and referring to FIGS. 1 and 2, such includes three layers of plywood referred to as one face layer indicated at a in FIG. 2, an intermediate layer indicated at b in FIG. 2, and an opposite face layer indicated at c in FIG. 2. Face layer a includes vertical plywood segments 30, 32 extending the entire length of the core piece (such having been broken away in FIG. 1 to illustrate at the upper right hand portion of FIG. 1 portions of the intermediate layer, and to indicate at upper left hand portions of FIG. 1, portions of the opposite face layer). Extending between these vertical plywood segments at the bottom and top of the door are horizontal plywood segments 34, 36. In intermediate layer b, horizontal plywood segments 38 at the top and bottom of the door extend the entire width of the core piece and vertical segments 40 extend between inner edges of these horizontal segments. Layer c may have the same segments as in layer a, i.e., vertical segments 42 extending the entire length of the core piece and horizontal segments 44 extending between the vertical segments. With this manner of manufacture and with plywood segments overlapped, in the corner regions there are continuations of veneer layers forming part of the vertical expanses as well as layers forming part of the horizontal expanses. FIG. 8 illustrates veneer layers, and how layers in segment 38 overlap veneer layers in segment 42. In the core piece the various segments are adhered to each other using conventional adhesive.

The core piece has edge surfaces bounding the perimeter of the core, and bounding opening 20, which extend normal to the planes of the faces of the core piece.

These are overlaid with edge band strips exemplified by strips 46, 48. These strips have a width corresponding to the thickness of the core piece so that opposite margins of the edge band strips lie generally in the plane of opposite faces of the core piece The core piece with edge band strips applied thereto form an integral component, such being referred to herein as a core panel. In the core panel, edge surfaces extending about opening 20 and about the perimeter of the panel are formed by the exposed surfaces of the edge band strips.

A series of molding strips, such as strips 50, are secured in place within opening 20 adjacent one face of the core panel to provide support for one side of light-transmitting panel 22. Similar strips 52 are secured in place within the opening and adjacent the opposite side of the core panel to support the opposite side margins of the light-transmitting panel.

In the completed door as shown in FIG. 3, a veneer overlay 54 is applied over each of opposite faces of the core. The overlay covers the core piece as well as side margins of the edge band strips,i.e., the core panel is completely covered over its opposite faces. The overlay includes vertical veneer pieces such as pieces 54*a* extending the entire length of a vertical expanse with grain extending vertically. The graining along the base of the door and between these vertical pieces is by horizontal veneer pieces such as veneer piece 54*b* with grain extending in a horizontal direction.

Figure 5:
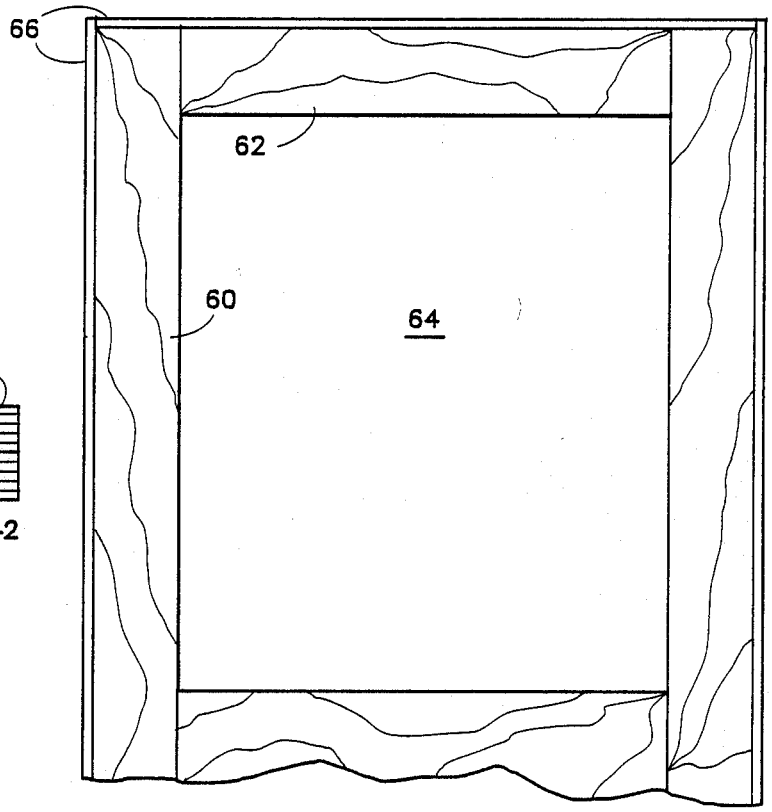
FIG. 5 is a view illustrating portions of the face of a core panel according to a modification of the invention where the door prepared therefrom is an entry door.
Figure 6:
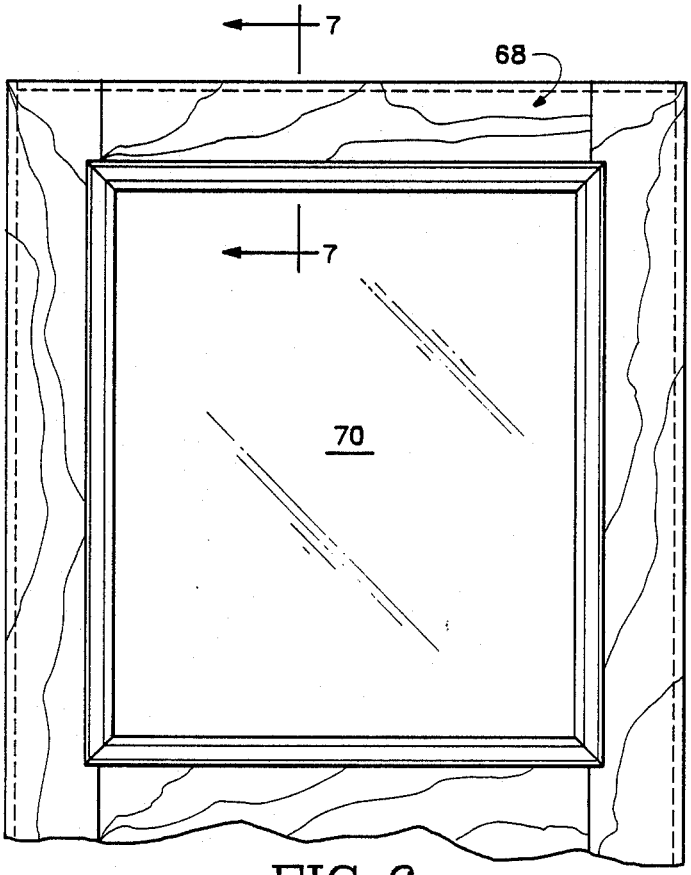
FIG. 6 is a view similar to FIG. 5, but showing, with portions broken away, a completed door prepared from the core panel shown in FIG. 5.
Figure 7:
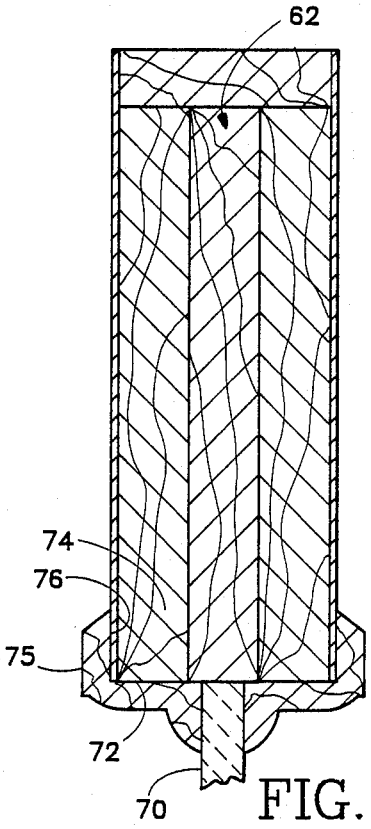
FIG. 7 is a cross-sectional view (enlarged), taken generally along the line 7—7 in FIG. 6.

Referring now to FIGS. 5, 6, and 7, in these figures there is shown a modified form of the invention as incorporated, for instance, with an entry or lighted door. A core piece is prepared as shown in FIG. 5 with vertical and horizontal expanses 60 and 62 delineating therebetween a light-transmitting, panel receiving opening 64. The core piece may be prepared with overlapped plywood pieces as described in connection with the core piece illustrated in FIG. 1. Edge band strips 66 are secured in covering relation over outer edges of the door core piece. Such band strips, however, may be eliminated from the inner edges of the door core piece that define opening 64 i.e., the completed core panel in this instance includes only outer edge band strips.

To opposite faces of the core panel, a veneer overlay 68 is adhesively applied with such extending over margins of the edge band strips, and having vertical graining, in the case of the vertical expanses and horizontal graining, in the case of expanses extending horizontally at the top and bottom of the door.

So-called "eye-brow" molding is employed in the mounting of light-transmitting panel 70. Specifically, each of the inner edge surfaces of the core panel defining opening 64, as exemplified by inner edge surface 72, extends generally normal to the faces of the core panel. An edge surface and the core faces, where they meet, define what are referred to as elongate corner shoulders, one being indicated at 74. The "eye-brow" molding 75 is configured as shown in FIG. 7, and includes an elongate, recessed, shoulder-receiving channel 76 extending therealong which fits over a corner shoulder as defined. "Eye-brow" molding is applied on each side of the core panel to provide support for opposite margins of the light-transmitting panel. The molding includes, as explained, a portion which fits within the opening and a portion which overlies the outer face of the door.

The doors described are strong and resist sagging and other distortion as typifies conventional stile and rail doors. A firm mounting is provided for the light-transmitting panel incorporated with the door. The doors have the appearance of being made entirely from the wood of the veneer used in overlaying the door core. The "eye-brow" molding, discussed in connection with one modification of the invention, permits securement of the molding to the door through face regions of the door. It also pleasingly accents the light-transmitting panel which the molding encompasses.

While modifications and variations of the invention have been described, obviously others are possible.

It is claimed and desired to secure by letters patent:

1. In a door which generally extends in a plane and has opposed sides and which includes a light-transmitting panel permitting the passage of light therethrough, an integrated core panel for the door made up of multiple veneer layers extending generally in the plane of the door and said layers being adhesively secured together, the core panel having opposed sides facing opposite sides of the door, said core panel having an opening therein which receives the light-transmitting panel and which is bounded by horizontal and vertical expanses in the core panel, said horizontal and vertical expanses having inner edge surfaces delineating said opening which extend in planes disposed normal to the plane of the door and which extend without interruption between opposite sides of the core panel, said horizontal and vertical expanses merging at corner regions, which corner regions are disposed outwardly of corner extremities of said opening, the veneer layers of the core panel at said corner regions including layers which are continuations of a vertical expanse and layers which are continuations of a horizontal expanse and said layers overlapping, thus to integrate the core panel at said corner regions, a veneer overlay extending in covering relation over each of opposite sides of the core panel and said overlay terminating at the planes of said inner edge surfaces and having margins adjacent said inner edge surface, said light-transmitting panel having opposite sides and outer edges bounding the light-transmitting panel and marginal panel surfaces on each of opposite sides of the light-transmitting panel joining with said outer edges, said light-transmitting panel occupying said opening with said outer edges of the light-transmitting panel located inwardly of said inner edge surfaces of said expanses, a first series of molding strips secured within said opening abutting said inner edge surfaces of said expanses adjacent one side of the door and abutting and supporting marginal panel surfaces of the light-transmitting panel on one side of the light-transmitting panel, and a second series of molding strips secured within said opening abutting said inner edge surfaces adjacent the other side of the door and abutting and supporting marginal panel surfaces of the light-transmitting panel on the other side of the light-transmitting panel, said molding strips including portions extending the length of the molding strips which overlie and conceal said margins of said veneer overlays.

2. In a door which generally extends in a plane and has opposed sides and which includes a light-transmitting panel permitting the passage of light therethrough, a core piece for the door made up of multiple veneer layers extending generally in the plane of the door and said layers being adhesively secured together and the core piece having opposed sides facing opposite sides of the door, said core piece having horizontal and vertical expanses each bounded by an inwardly facing edge, edge band strips secured to said inwardly facing edges of the horizontal and vertical expanses and said edge band strips having inwardly facing surfaces and each inwardly facing surface of an edge band strip extending in a plane disposed normal to the plane of the door and extending without interruption and throughout the width of the core piece from one side of the core piece to the other side of the core piece, said inwardly facing surfaces of the edge band strips delineating an opening which receives the light-transmitting panel, the veneer layers of the core piece at said corner regions including layers which are continuations of a vertical expanse and layers which are continuations of a horizontal expanse and said layers overlapping thus to integrate the core piece at said corner regions, said light-transmitting panel having opposite sides and outer edges bounding the light-transmitting panel and marginal panel surfaces on each of opposite sides of the light-transmitting panel joining with said outer edges, said light-transmitting panel occupying said opening with said outer edges of the light-transmitting panel located directly inwardly of said inwardly facing surfaces of said edge band strips, a first series of molding strips secured within said opening abutting the inwardly facing surfaces of said edge band strips adjacent one side of the door and abutting and supporting marginal panel surfaces of the light-transmitting panel on one side of the light-transmitting panel, and a second series of molding strips secured within said opening abutting said inwardly facing surfaces of the edge band strips adjacent the other side of the door and abutting and supporting marginal panel surfaces of the light-transmitting panel on the other side of the light-transmitting panel, and a veneer overlay extending in covering relation over each of opposite sides of the core piece, said overlays having margins extending inwardly over the sides of the edge band strips and terminating at the planes of said inwardly facing surfaces of the edge band strips.

* * * * *